US005572936A

United States Patent [19]

Chroniger

[11] Patent Number: 5,572,936

[45] Date of Patent: Nov. 12, 1996

[54] ROTATING CAKE SUPPORT

[76] Inventor: Helenice Chroniger, 96 Meade Dr., Gettysburg, Pa. 17325

[21] Appl. No.: 264,519

[22] Filed: Jun. 23, 1994

[51] Int. Cl.[6] ..... A47B 57/00

[52] U.S. Cl. ..... 108/94; 108/101

[58] Field of Search ..... 108/94, 97, 93, 108/91, 51.1, 153, 182, 191, 101, 156; 211/153, 135; 206/597, 524.2, 524.9; 428/284, 211, 913

[56] References Cited

U.S. PATENT DOCUMENTS

| | | | |
|---|---|---|---|
| 2,453,443 | 11/1948 | Logan | 108/94 |
| 2,981,580 | 4/1961 | Hansen | 108/27 |
| 4,907,515 | 3/1990 | Win | 108/51.1 |
| 4,931,340 | 6/1990 | Baba et al. | 108/51.1 X |
| 5,328,743 | 7/1994 | Wynne et al. | 428/105 |
| 5,392,912 | 2/1995 | Grubbs | 206/451 |

*Primary Examiner*—José V. Chen
*Attorney, Agent, or Firm*—Stephen R. Greiner

[57] ABSTRACT

A rotating cake support including a pair of horizontally disposed pallets joined together by a number of tubular pillars is disclosed. The upper pallet directly supports a cake plate having a central bore for rotational engagement with a peg which extends upwardly from the upper pallet. The periphery of the cake plate is provided with a resilient band forming a moisture impermeable barrier for ensuring the longevity of the plate.

18 Claims, 3 Drawing Sheets

ROTATING CAKE SUPPORT

FIELD OF THE INVENTION

The present invention relates generally to horizontally supported planar surfaces and, in particular, to a device for rotationally supporting a plurality of terraced, horizontal tiers of a fancy cake.

BACKGROUND OF THE INVENTION

Bakers have long known the difficulties associated with successfully constructing multi-tiered cakes such as those traditionally seen at weddings. Alignment of the fanciful decorations and garlands added to the exposed surfaces of the stacked tiers so as to present a visually appealing design has always been especially problematic. Some relief, however, has been offered by the tier support system for fancy cakes illustrated in U.S. Pat. No. 4,069,772, issued Jan. 24, 1978 to Ray Haapala, which permits individual rotation of cake tiers for the coordination of decorations.

Haapala provides a complicated, knock-down apparatus including a first pallet supported by a plurality of leg members. The upper portion of each leg member has an intricate locking mechanism for securing the leg members within radially spaced holes in the first pallet. A spike, removably engagable with a central hole, provides a pivot point for a second, cake supporting pallet rotatably accommodated thereon. The large number of individual parts in the apparatus makes it is relatively expensive to manufacture. As disposal after a single use, typical with similar cake supports, is, thus, unacceptable, washing the apparatus for reuse is necessary. Unfortunately, washing is hampered by the required handling of a great number of small parts—a loss of any one of which being potentially disabling to further use of the apparatus. A need, therefore, exists for a rotating cake support of simplified construction which may be produced at minimal cost and economically disposed of after initial use if desired.

SUMMARY OF THE INVENTION

Accordingly, it is a principal object of the invention to provide a rotating cake support of uncomplicated construction, and having relatively few component parts, which permits the individual rotation of the multiple cake tiers in a fancy cake to align their decorated features and surfaces.

It is another object of the invention to provide a rotating cake support wherein its sustaining elements do not penetrate or pierce the cake surface so as to cause damage or inhibit cutting.

It is a further object of the invention to provide a rotating cake support with an upper pallet having arcuate edges offering ample room for the fingers of one assembling a multi-tiered cake to securely brace the cake plate as it is positioned thereby minimizing the likelihood of damage to the cake and its fragile decorative features.

It is an object of the invention to provide improved elements, and arrangements thereof, in a rotating cake support for the purposes described which is inexpensive to manufacture, dependable and fully effective in accomplishing its intended purposes.

These and other objects of the present invention will become readily apparent upon further review of the following specification and drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENTS

Figure 1:
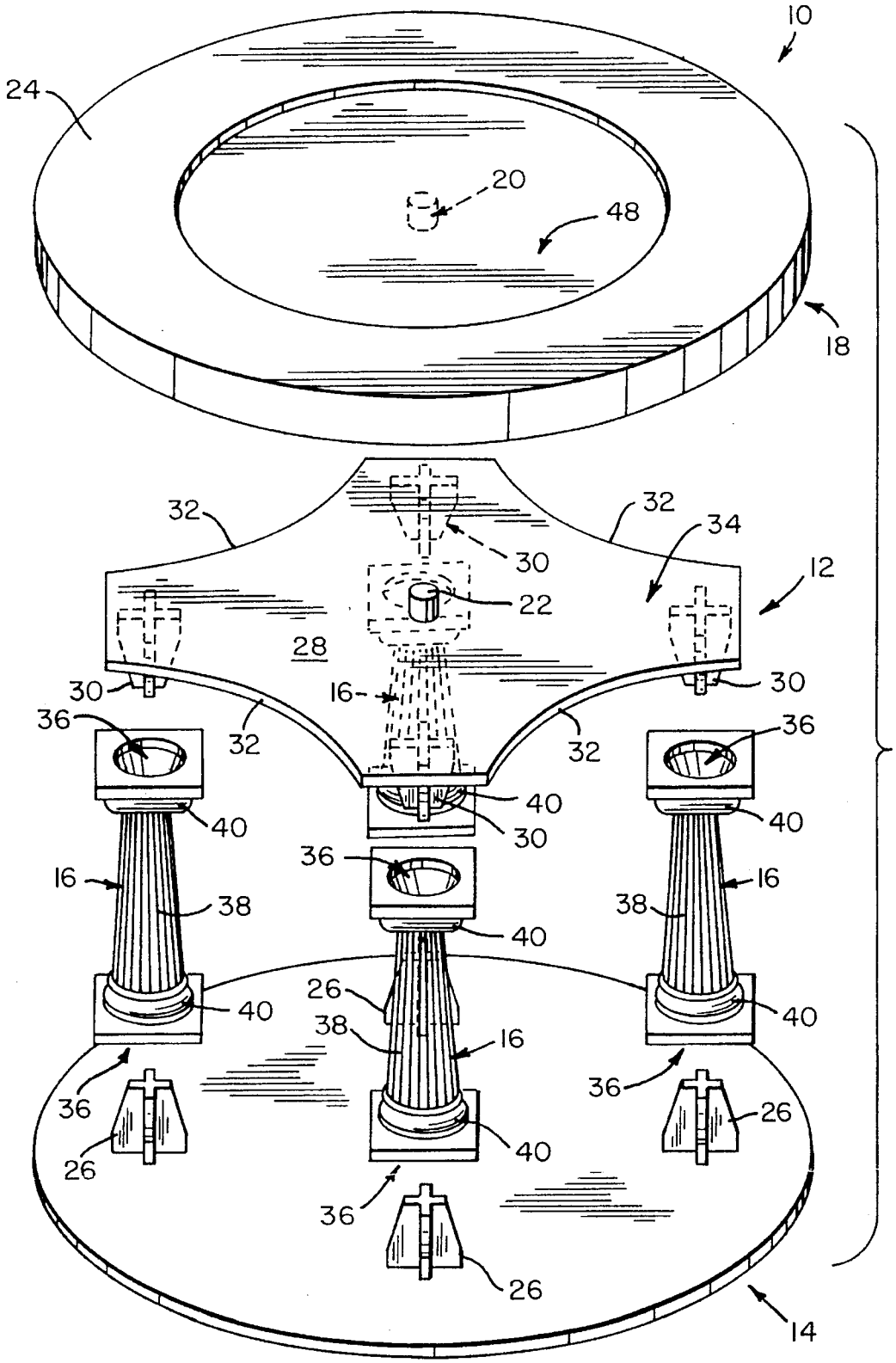
FIG. 1 is an exploded view of a rotating cake support in accordance with the present invention.

Referring now to FIG. 1, a rotating cake support 10 in accordance with the present invention is shown. The support 10 includes a pair of horizontally disposed pallets 12 and 14 joined together by a number of tubular pillars 16. The upper pallet 12 directly supports a cake plate 18 having a central bore 20 for rotational engagement with a peg 22 extending upwardly from the upper pallet 12. About the periphery of the cake plate 18 is secured a plastic band 24 forming an impermeable barrier to the passage of moisture and ensuring the longevity of the plate 18.

Although one or more layers of corrugated paper may be employed, in its preferred form, the lower pallet 14 comprises a flat, solid, circular disk, molded from a thermoplastic material such as high-impact polystyrene. The lower pallet 14 is provided with four, integral projections 26 extending upwardly from the top surface thereof. Each of the projections 26, spaced 90 degrees apart so as to appear at 3:00, 6:00, 9:00 and 12:00 o'clock positions, is defined by a fin of cruciform cross section and tapering generally in width from its base to its flattened apex—a distance of 0.75 inches (1.9 centimeters).

The upper pallet 12 comprises a flat, solid plate 28 having a lateral extent which is less than that of the cake plate 18 for permitting the cake plate to be readily grasped by a user. The upper pallet includes both an upper and a lower surface and is molded from high-impact polystyrene. Extending downwardly from the lower surface of the plate are four, integral projections 30 identical in form to those found on the lower pallet 14. Each of the projections 30 is positioned to directly overlay a corresponding projection 26 of the lower pallet 14 during use of the instant invention.

The peripheral edge or border of the upper pallet 12 is provided with a plurality of angularly divided segments, four of which are inwardly curved or concave, as at 32, and together define four, short, tapering branches as at 34 having at their respective ends one of the downwardly depending projections 30. The arcuate edges 32 offer ample room for the fingers of one assembling a multi-tiered cake to securely brace the cake plate 18 as it is fully positioned upon the upper pallet 12 thereby minimizing the likelihood of damage to the cake and its fragile decorative features. In this regard, it has been found that adequate area for finger positioning is gained by furnishing the arcuate edges 32 with a radius of curvature substantially identical to the radius of the associated cake plate 18.

Extending upwardly from the center of the upper surface of the upper pallet 12 is a short peg 22. Preferably, the peg 22 is cylindrical in shape and is integrally molded with the remainder of the upper pallet 12. The peg 22 serves as a hub for the rotation of the cake plate 18 which may be selectively positioned thereon.

The pallets 12 and 14 are maintained in a spaced apart relationship by four vertical pillars 16 having a preferred configuration which is known in the art. As shown, the pillars 16 are substantially circular in cross section and comprise short tubes of predetermined length which are open at each of their respective ends for receiving the projections 26 and 30. For a snug and easily disconnected fit with each of the projections 26 and 30, however, the open top and bottom ends of the pillars 16 are each provided with a conical end socket 36 adapted to closely receive one projection, frictionally engaging the marginal edges of the projections. The pillars 16 are preferably molded from a thermoplastic material and may readily be provided with surface ornamentation such as fluting 38 and capitals 40 of Grecian influence, if desired. Whereas the fluting 38 somewhat reduces the weight of the pillars 16, the relatively greater amounts of thermoplastic material in the capitals 40 permits the sockets 36 to be partially strengthened or reinforced.

Figure 2:
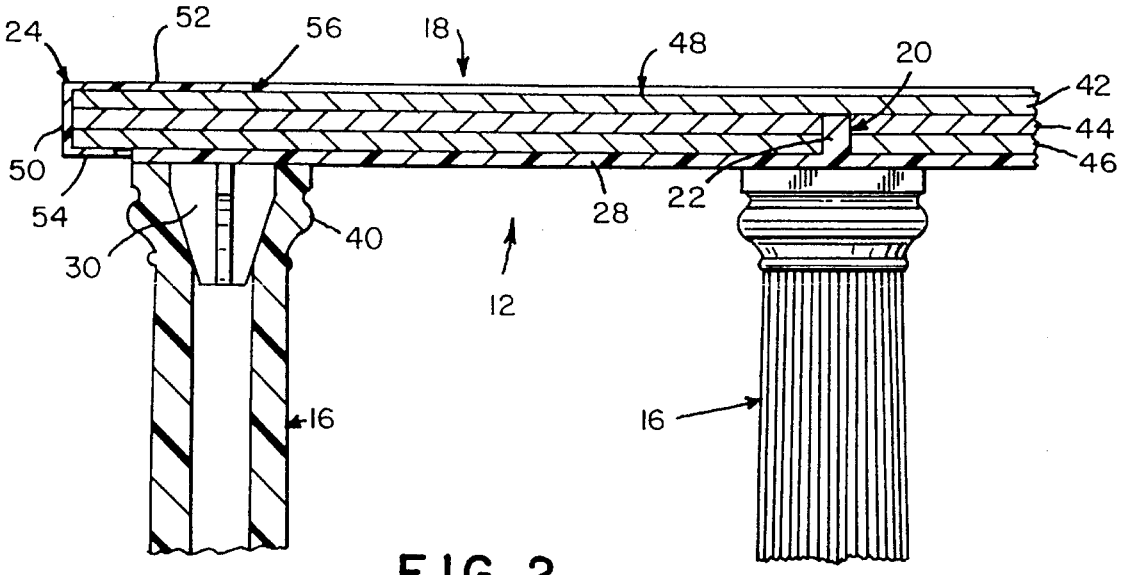
FIG. 2 is a vertical cross-sectional view showing details of the preferred cake plate and upper pallet of the present invention.

A rigid cake plate 18 directly sustains a cake layer for rotation relative to the remainder of the support 10. With reference to FIGS. 1 and 2, it will be noted that the plate 18 includes three, corrugated paper disks 42, 44, and 46 of like diameter superimposed upon one another in a stacked relationship and glued together by means of a well-known adhesive cement. For strength, the internal corrugations of the disks 42, 44, and 46 may be angularly offset in well-known fashion. The paper material comprising the upper and lower surfaces of the cake plate 18 may be covered with a foodsafe, waterproof coating 48, such as paint or wax, for preventing the flow of moisture from the cake into the plate and, thus, weakening it. The coating material 48 may be clear or pigmented to enhance appearance.

A bore 20 is provided in the center of the cake plate for close rotational engagement with the peg 22. As may be seen in FIG. 2, the bore 20 only partially penetrates the cake plate 18, passing through the lower corrugated paper disks 44 and 46, but not entering the upper disk 42. Preferably, the respective portions of the bore 20 found in each of the paper disks 44 and 46 are drilled, or otherwise formed, prior to being secured to the imperforate upper disk 42 for ease of handling.

A band 24, having a generally C-shaped cross section, is closely fitted about the peripheral edge of the cake plate 18 to protect the edge of the plate from moisture seeping from the cake which, otherwise, could result in warping of the corrugated paper disks 42, 44, and 46. The band 24 includes a vertical portion 50 for engagement with the sides of the conjoined disks 42, 44, and 46 which define the peripheral edge of said cake plate. An upper, annular ring 52 is integrally joined to the top of the vertical portion 50 and projects inwardly, along the top of the upper, corrugated paper disk 42, toward the center of the plate 18. A lower, annular ring 54 is integrally joined to the bottom of the vertical portion 50 and, likewise, projects inwardly, along the bottom of the lower, corrugated paper disk 46, toward the center of the plate 18. As may be seen in FIG. 2, the upper ring 52 has a width which is several times greater than that of the lower ring 54. In this manner, the upstanding, inner circular edge 56 of the upper ring 52 may be completely disposed beneath a circular cake layer having a diameter much smaller than that of the plate 18 and resting thereon. Thus, by way of example, a circular cake layer having a diameter as small as 5 inches (13 centimeters) may be readily accommodated by an 8 inch (20 centimeter) diameter cake plate 18 wherein the width of the upper ring 52 is 1.5 inches (3.8 centimeters). The lower ring 54, having a usual width of 0.25 inches (0.64 centimeters), has been found to provide a sufficient barrier to moisture in the atypical situations where damp frostings or cakes are brought into contact with the bottom of the plate 18.

Figure 2A:
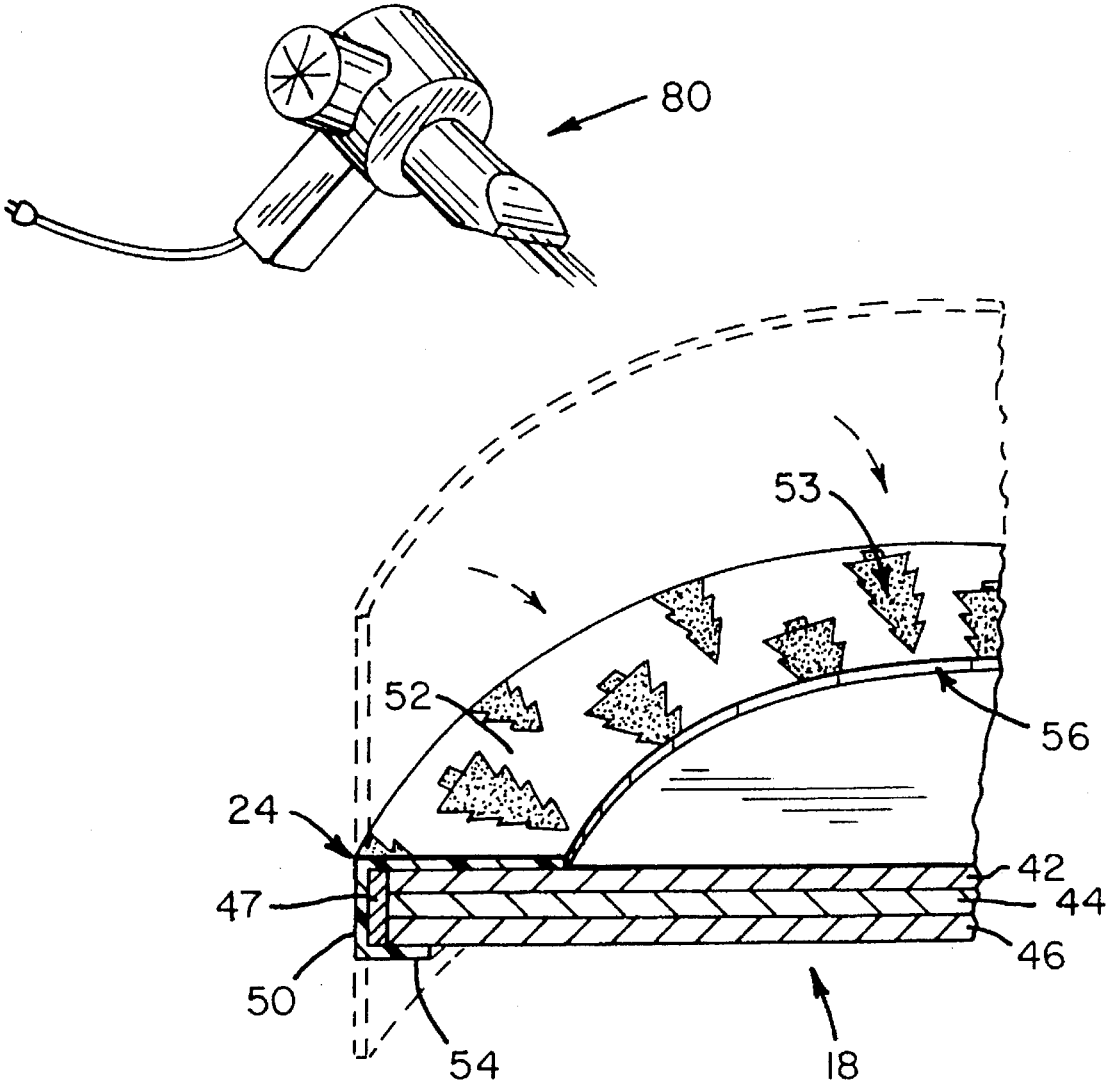
FIG. 2A is a partial, cross-sectional view showing details of an alternative cake plate.

The band 24 may be formed from one of a number of suitable materials. Resilient vinyl is preferable as such is impermeable to moisture, may be remotely molded or otherwise formed, and may be readily snap-fit into position about the periphery of the conjoined disks 42, 44, and 46. In the alternative, adhesive plastic tape or "heat shrink" materials may also be used with equal facility. With regard to the latter materials, Pro-Tek Packaging Group, Inc., of Hauppauge, N.Y., and Crystal Vision of Torrence, Calif., both distribute a polyvinylchloride (PVC) product, generically referred to as "Shrink Bands," which has heretofore been used to provide a tamper-proof seal for jars of food products and the like. For use in the instant invention, however, it has been found that Shrink Bands forming a closed loop with a perimeter length slightly greater than the circumference of a cake plate 18 and a width of 75 millimeters are preferable. As shown in FIG. 2A, after appropriately positioning such a Shrink Band about the periphery of the cake plate 18, high temperature air from a heat gun 80 is applied to the undeformed Shrink Band indicated by broken lines. With the continued application of heated air, the PVC material within the Band contracts in both length and width so that the originally flat cross-sectional configuration of the Shrink Band takes on the desired C-shaped cross section having a vertical portion 50, an upper annular ring 52, and a lower annular ring 54 as described hereinabove.

Because of the significant tensile forces exerted by the Shrink Band in its contraction to the desired C-shaped form, it has been found desirable to reinforce the periphery of the conjoined, corrugated paper disks 42, 44 and 46 with a strip of heavy paper 47, as shown in FIG. 2A, to prevent crushing of the corrugated paper. The paper strip 47, having a height equivalent to that of the combined thicknesses of the corrugated paper disks 42, 44 and 46, approximately 0.375 inches (0.95 centimeters), is preferred as such provides a pair of sharp annular edges about the top and bottom of the cake plate 18 after the Shrink Band has been applied thereto. The paper strip 47 is initially secured to the periphery of the conjoined disks 42, 44 and 46 by the application of small amounts of adhesive cement at spaced intervals about the disks. The contracted Shrink Band locks the paper strip 47 in place.

Figure 3:
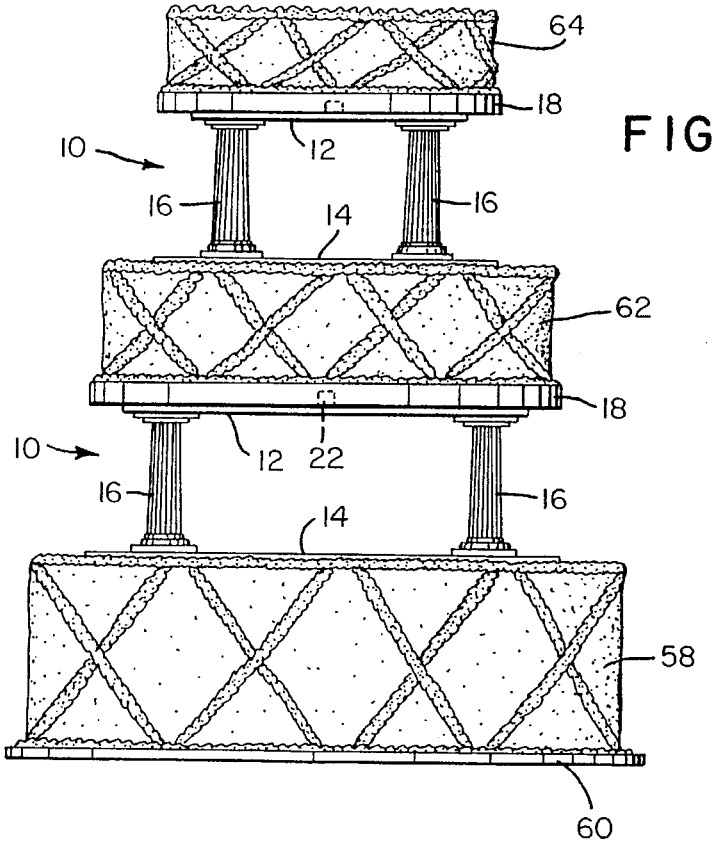
FIG. 3 is a side elevational view illustrating the use of a number of rotating cake supports in a multi-tiered cake.

The paper strip 47 not only reinforces and strengthens the cake plate 18 but, also, maximizes the height of the vertical portion 50 by preventing the crushing of the underlying supporting structure of corrugated material. As the Shrink Band can be provided with printed indicia 53 in the form of company logos, decorative patterns, or designs indicative of holiday themes, such as the Christmas trees shown in FIG. 2A, the visibility of the indicia found at the periphery of the cake plate is enhanced by the paper strip 47. Of course, after the usual assembly of a multi-tiered cake as illustrated in FIG. 3, it is only the indicia found upon the vertical portion 50 which will be apparent to the casual observer. Therefore, by preventing the crushing of the corrugated paper disks 42, 44 and 46 upon the application of the Shrink Band, indicia having a relatively larger size may be applied to the vertical portion for effortless viewing from a correspondingly greater distance.

Although the Shrink Band material has a thickness of approximately 0.002 inches (0.05 millimeters), when the material comprising the band has a thickness in its applied state of about 0.06 inches (0.16 centimeters), the upstanding edge 56 provides a significant barrier to the lateral movement of the accommodated cake layer. Thus, in the event of an inadvertent tilt of the cake plate 18 prior to the assembly of the support 10, the upstanding edge 56 will frictionally engage the bottom surface of the accommodated cake layer and restrain such from movement.

FIG. 3 illustrates the use of the instant rotating cake support 10. As shown, the base tier 58 of a multi-tiered cake is secured to a cake board 60, comprising a disk of corrugated paper or plastic, which has been located at a site where assembly of the finished cake is desired. Next, the pillars 16 are connected at their upper and lower ends to the pallets 12 and 14, and the resulting structure is then centrally positioned upon the top of the base tier 58. If the upper tiers of the cake are relatively large or heavy, it may be desirable to insert a plurality of wooden dowels (not shown), having a length equal to the thickness of the base tier 58, vertically into the base tier prior to placing the aforesaid structure thereon so as to prevent the weight of the upper tiers from being transferred directly to the upper surface of the base tier and thereby preventing the crushing of the base tier.

The next tier 62, previously positioned upon the cake plate 18, is placed on the upper pallet 12 so that the peg 22 is seated in the bore 20. If the decorations of the upper tier 62 are not in proper alignment with those of the base tier 58, the cake plate 18 may be rotated at will about the peg 22 until the desired alignment is achieved. The process is then repeated for additional tiers until the top tier of the cake is correctly positioned. Of course, any of the supports 10 which are incorrectly positioned upon a lower cake tier may be lifted and moved laterally without the attendant harm associated with removing pillars of the type which pierce the cake layers themselves.

It should be noted that although a fancy cake having three tiers 58, 62, and 64 is illustrated in FIG. 3, the instant rotating cake support 10, may be employed in cakes having as few as two tiers and, perhaps more than three tiers if desired. Because the multiple cake tiers of the usual fancy cake are each provided with a different size, and are arranged with the largest at the bottom and the smallest at the top, the rotating cake supports 10 between the tiers of such a cake may be similarly sized for stability and strength. Thus, the cake supports 10 positioned close to the bottom of the cake illustrated in FIG. 3 are provided with a somewhat larger size than those positioned relatively close to the top of the cake. Nevertheless, the construction of the various supports 10 positioned in the cake is the same.

It is to be understood that the present invention should not be not limited to the sole embodiment described above and various modifications may be made without effect to the utility thereof. For instance, as will be apparent to one skilled in the art, the material used in fabricating the pallets 12 and 14 may be plastic of various colors, corrugated paper, particle board, or plywood of one or more layers or laminations. Furthermore, the projections 26 and 30, employed to secure the pillars 16 to the upper and lower pallets 12 and 14, may be provided with a tapered conical form, rather than a cruciform cross section, so as to closely engage the interior walls of the sockets 36. For purposes of economy, the projections 26 may be eliminated altogether and well-known adhesive cements may be substituted therefor to secure the pillars 16 to the lower pallet 14. Thus, the invention must be understood to encompass any and all embodiments within the scope of the following claims.

I claim:

1. A rotating cake support, comprising:

an upper pallet having an upper surface and a lower surface and including a plurality of first, radially-spaced, angularly-disposed projections extending downwardly from said lower surface and a peg extending upwardly from the center of said upper surface, said plurality of first projections and said peg being integrally molded with said upper pallet from a thermoplastic material;

a lower pallet having a top surface and a bottom surface and including a plurality of second, radially-spaced, angularly-disposed projections extending upwardly from said top surface, said plurality of second projections corresponding in number to said first projections;

a plurality of vertical pillars adapted to support said upper pallet at a predetermined height above said lower pallet, each said pillar having top and bottom end sockets to engage a corresponding pair of said first and said second projections; and, a cake plate disposed upon and rotatably supported by said upper pallet, said cake plate having a central bore adapted to rotatably accommodate said peg.

2. A rotating cake support, comprising:

an upper pallet having an upper surface and a lower surface and including a plurality of first, radially-spaced, angularly-disposed projections extending downwardly from said lower surface and a peg extending upwardly from the center of said upper surface;

a lower pallet having a top surface and a bottom surface and including a plurality of second, radially-spaced, angularly-disposed projections extending upwardly from said top surface, said plurality of second projections corresponding in number to said first projections, said plurality of second projections being integrally molded with said lower pallet from a thermoplastic material;

a plurality of vertical pillars adapted to support said upper pallet at a predetermined height above said lower pallet, each said pillar having top and bottom end sockets to engage a corresponding pair of said first and said second projections; and, a cake plate disposed upon and rotatably supported by said upper pallet, said cake plate having a central bore adapted to rotatably accommodate said peg.

3. The rotating cake support according to claim 1 wherein said upper pallet has a lateral extent less than that of said cake plate for permitting said cake plate to be readily grasped by a user.

4. The rotating cake support according to claim 3 wherein said upper pallet has a peripheral edge which includes a plurality of angularly divided segments, at least one of said segments being concave.

5. The rotating cake support according to claim 1 wherein said cake plate comprises a plurality of corrugated paper disks secured together in a stacked relationship.

6. A rotating cake support, comprising:

an upper pallet having an upper surface and a lower surface and including a plurality of first, radially-spaced, angularly-disposed projections extending downwardly from said lower surface and a peg extending upwardly from the center of said upper surface;

a lower pallet having a top surface and a bottom surface and including a plurality of second, radially-spaced, angularly-disposed projections extending upwardly from said top surface, said plurality of second projections corresponding in number to said first projections;

a plurality of vertical pillars adapted to support said upper pallet at a predetermined height above said lower pallet, each said pillar having top and bottom end sockets to engage a corresponding pair of said first and said second projections; and, a cake plate including a plurality of corrugated paper disks secured together in a stacked relationship, said cake plate being disposed upon and rotatably supported by said upper pallet, said cake plate having a central bore adapted to rotatably accommodate said peg, said central bore does not fully penetrate the uppermost one of said plurality of corrugated paper disks.

7. A rotating cake support, comprising:

an upper pallet having an upper surface and a lower surface and including a plurality of first, radially-spaced, angularly-disposed projections extending downwardly from said lower surface and a peg extending upwardly from the center of said upper surface;

a lower pallet having a top surface and a bottom surface and including a plurality of second, radially-spaced, angularly-disposed projections extending upwardly from said top surface, said plurality of second projections corresponding in number to said first projections;

a plurality of vertical pillars adapted to support said upper pallet at a predetermined height above said lower pallet, each said pillar having top and bottom end sockets to engage a corresponding pair of said first and said second projections; and, a cake plate including a plurality of corrugated paper disks secured together in a stacked relationship, said cake plate being disposed upon and rotatably supported by said upper pallet, said cake plate having a central bore adapted to rotatably accommodate said peg, said cake plate further including a resilient band secured about the peripheral edge thereof.

8. The rotating cake support according to claim 7 wherein said cake plate further includes a paper strip disposed between said plurality of corrugated paper disks and said resilient band for reinforcing said cake plate.

9. The rotating cake support according to claim 7 wherein said resilient band is substantially C-shaped in cross section and includes:

a vertical portion for engagement with said peripheral edge of said cake plate;

an upper, annular ring integrally joined to said vertical portion and projecting inwardly toward the center of said cake plate; and a lower, annular ring integrally joined to said vertical portion and projecting inwardly toward the center of said cake plate.

10. The rotating cake support according to claim 9 wherein said upper, annular ring has a width which is greater than that of said lower, annular ring.

11. The rotating cake support according to claim 9 wherein said upper, annular ring includes an inner circular edge of predetermined thickness for preventing the lateral movement of a cake positioned upon the top of said cake plate.

12. A rotating cake support, comprising:

an upper pallet having an upper surface and a lower surface and including a plurality of radially-spaced, angularly-disposed projections extending downwardly from said lower surface and a peg extending upwardly from the center of said upper surface, said plurality of projections and said peg being integrally molded with said upper pallet from a thermoplastic material;

a lower pallet having a top surface and a bottom surface;

a plurality of vertical pillars, corresponding in number to said projections and adapted to support said upper pallet at a predetermined height above said lower pallet, each said pillar having a top end socket for selective engagement with one of said plurality of projections and a base for attachment to said top surface; and, a cake plate disposed upon and rotatably supported by said upper pallet, said cake plate having a central bore adapted to rotatably accommodate said peg.

13. The rotating cake support according to claim 12 wherein said lower pallet comprises a corrugated paper disk.

14. The rotating cake support according to claim 13 wherein adhesive cement attaches said plurality of vertical pillars to said lower pallet.

15. A rotating cake support, comprising:

an upper pallet having a lower surface and an upper surface and including a plurality of first, radially-spaced, angularly-disposed projections extending downwardly from said lower surface and a peg extending upwardly from the center of said upper surface, said plurality of first projections and said peg being integrally formed with said upper pallet, said upper pallet further having a peripheral edge which includes a plurality of angularly divided segments, at least one of said segments being inwardly concave;

a lower pallet having a top surface and a bottom surface and including a plurality of second, radially-spaced, angularly-disposed projections extending upwardly from said top surface, said plurality of second projections corresponding in number to said first projections, said plurality of second projections further being integrally formed with said lower pallet;

a plurality of pillars adapted to support said upper pallet at a predetermined height above said lower pallet, each said pillar having end sockets to engage a corresponding pair of said first and second projections;

a cake plate disposed upon and supported by said upper pallet for rotation about said peg, said cake plate including a plurality of corrugated paper disks secured together in a stacked relationship, said cake plate having a central bore adapted to accommodate said peg, said central bore not fully penetrating the uppermost one of said plurality of corrugated paper disks; and a band secured about the periphery of said cake plate, said band having a substantially C-shaped cross section.

16. A cake plate, comprising:

a plurality of corrugated paper disks secured side-by-side in a stacked relationship;

a resilient band secured about the peripheral edge of at least one of said plurality of corrugated paper disks; and, a paper strip disposed between said plurality of corrugated paper disks and said resilient band for reinforcing said cake plate.

17. A cake plate, comprising:

a plurality of corrugated paper disks secured side-by-side in a stacked relationship;

a resilient band secured about the peripheral edge of at least one of said plurality of corrugated paper disks, said resilient band being substantially C-shaped in cross section and including:

a vertical portion for engagement with said peripheral edge of said cake plate;

an upper, annular ring integrally joined to said vertical portion and projecting inwardly toward the center of said cake plate; and a lower, annular ring integrally joined to said vertical portion and projecting inwardly toward the center of said cake plate.

18. The cake plate according to claim 16 wherein said resilient band comprises a heat shrink material.

* * * * *